US008910398B2

(12) United States Patent
Cerciello

(10) Patent No.: US 8,910,398 B2
(45) Date of Patent: Dec. 16, 2014

(54) DRYING SYSTEM OF A COATED CONTINUOUS FILM

(75) Inventor: Antonio Cerciello, Piacenza (IT)

(73) Assignee: Nordmeccanica S.p.A., Piacenza (PC) (IT)

( * ) Notice: Subject to any disclaimer, the term of this patent is extended or adjusted under 35 U.S.C. 154(b) by 939 days.

(21) Appl. No.: 13/053,761

(22) Filed: Mar. 22, 2011

(65) Prior Publication Data

US 2011/0232126 A1 Sep. 29, 2011

(30) Foreign Application Priority Data

Mar. 29, 2010 (IT) ..... PC2010A0013

(51) Int. Cl.
*F26B 13/00* (2006.01)
*F26B 25/20* (2006.01)
*F26B 13/14* (2006.01)

(52) U.S. Cl.
CPC ..... *F26B 25/20* (2013.01); *F26B 13/14* (2013.01)
USPC ..... 34/611; 34/620; 198/780; 198/782

(58) Field of Classification Search
CPC ..... F26B 25/20; F26B 13/14; F26B 13/10; F26B 13/28; F26B 21/004; F26B 15/12; H01L 21/67034; F16J 15/18
USPC ..... 34/611, 444, 618, 629, 620, 240; 198/844.2, 861.1, 780, 782, 786; 277/511, 523; 384/428; 193/35 R, 37, 193/35 C, 35 B
See application file for complete search history.

(56) References Cited

U.S. PATENT DOCUMENTS

| | | | | |
|---|---|---|---|---|
| 3,867,748 | A * | 2/1975 | Miller | 432/246 |
| 4,365,423 | A * | 12/1982 | Arter et al. | 34/463 |
| 5,007,826 | A | 4/1991 | Wuenning | |
| 5,549,305 | A * | 8/1996 | Freund | 277/511 |
| 6,655,041 | B1 | 12/2003 | Schmidt et al. | |
| 2003/0173436 | A1 * | 9/2003 | Bascom et al. | 241/242 |

OTHER PUBLICATIONS

Italian Search Report, dated Nov. 24, 2010, from corresponding Italian application.

* cited by examiner

*Primary Examiner* — Kenneth Rinehart
*Assistant Examiner* — Bao D Nguyen
(74) *Attorney, Agent, or Firm* — Young & Thompson

(57) ABSTRACT

A drying system of a coated continuous film equipped with roller conveyor devices of the continuous film that allow easy and rapid removal of the rollers from the system to facilitate cleaning and maintenance operations. The conveyor roller is substantially separable into two parts with at least one of the two support shafts separable from the rest of the roller to facilitate the disassembly and reassembly operations of the conveyor roller from and on the system. In this way, it is unnecessary to remove all the motion transmission elements connected to one of the two support shafts.

20 Claims, 5 Drawing Sheets

DRYING SYSTEM OF A COATED CONTINUOUS FILM

BACKGROUND OF THE INVENTION

1. Field of the Invention

The present invention relates to a drying system of a coated continuous film and in particular a system equipped with roller conveyor devices of said continuous film.

In detail, the invention relates to a drying system of a coated continuous film equipped with roller conveyor devices of the continuous film that allow easy and rapid removal of the rollers from the system to facilitate cleaning and maintenance operations.

2. Description of the Related Art

Said drying systems are substantially constituted by a tunnel through which a continuous film coated with a coating, such as adhesive or the like, is fed to heat said coating and allow evaporation of any solvents and humidity contained therein.

Most of these systems are provided internally with a plurality of motorized conveyor rollers adapted to convey said continuous film from an inlet side toward an outlet side, as well as to support said film inside the tunnel.

In prior art systems, said conveyor rollers comprise a cylinder to guide and support the continuous film, if necessary coated with a material with high friction coefficient, supported at the ends by two shafts integral with said cylinder and housed on support means housed in the frame of the system.

In detail, one of said support shafts of the roller conveyor device is also connected to motion transmission means, such as pulleys, sprockets or the like, which transmit motion from motor means to said conveyor roller.

To heat the coating material of the continuous film, for example adhesive or the like, jets or hot air are generally used, directed on the coated side of the film to cause evaporation and subsequent dispersion and expulsion of any solvents or humidity contained in said coating material.

During the air blowing operation, a non-volatile fraction of the coating material of the film may be nebulised by the jets of air and subsequently deposited on the whole of the inner surface of the tunnel and on the various components present inside the tunnel, in particular on the guide cylinders of the conveyor rollers.

Besides soiling the film during conveying thereof, the presence of this deposit of material on the rollers often causes noteworthy problems of alignment of the film inside the machine, above all when the section of continuous film being conveyed inside the tunnel reaches significant lengths (up to ten meters).

To prevent the aforesaid problems, these systems therefore require periodic internal cleaning, in particular thorough cleaning of the conveyor rollers. Currently, said cleaning operations can be carried out using two different methods, both somewhat inconvenient.

With the first method, the rollers are disassembled and cleaning is performed outside the machine.

This solution, which would undoubtedly ensure a satisfactory result from the point of view of cleaning, would however involve a substantial loss of time and unacceptable machine downtime and therefore is almost never used.

In fact, to remove the rollers from the machine it is necessary to dismantle the two roller supports and remove all the motion transmission elements that are connected to one of the two support shafts of said roller.

With the second method, cleaning is performed directly inside the machine without removing the rollers.

Therefore, in this case it is not necessary to disassemble the machine but, due to the small handling spaces inside the machine, the operator performing the operation is obliged to carry out a series of complicated manoeuvres that make it impossible for cleaning to be as accurate as when it is performed outside the machine.

Moreover, these components of the system are usually at a temperature that can even reach 150° C.; consequently the operator must wait several minutes before being able to perform the cleaning operations inside the machine.

In any case, when it is essential to disassemble the rollers, for example to carry out extraordinary maintenance, the time required for their removal from the system considerably affects the total time of the operation and therefore the machine downtime.

SUMMARY OF THE INVENTION

In this context, the object of the present invention is to propose a drying system of a coated continuous film that overcomes the aforesaid drawbacks of the prior art.

In particular, an object of the invention is to propose a drying system of a coated continuous film provided with roller conveyor devices of the film that make it possible to facilitate and improve cleaning operations of the conveyor rollers of the coated continuous film, and extraordinary maintenance operations on the system.

In detail, in the drying system of a coated continuous film according to the invention the roller conveyor devices of the continuous film are configured in such a manner as to allow easy removal of the conveyor rollers to allow cleaning operations thereof to be performed outside the machine, or to allow repair or replacement of components of the conveyor rollers.

A further object of the present invention is to provide a drying system of a coated continuous film equipped with roller conveyor devices of the continuous film provided with means adapted to allow the thermal expansions of the conveyor roller caused by the high temperatures inside the drying system.

The objects specified are substantially achieved by a drying system of a coated continuous film equipped with roller conveyor devices of the continuous film comprising a plurality of conveyor rollers supported at the ends by first support means and second support means, said conveyor roller comprising:

- a guide cylinder of a continuous film;
- a first support shaft integral with a first end of said guide cylinder housed in the first support means;
- a second support shaft placed at a second end of said guide cylinder housed in the second support means;

characterized in that said second support shaft has a first end adapted to couple with said second end of the guide cylinder, said first support shaft being slidable in said first support means, there being provided elastic means adapted to maintain said guide cylinder in contact with said second support shaft.

In practice, the conveyor roller is separable into two parts with at least one of the two support shafts, in this case the second support shaft, separable from the rest of the roller to facilitate the disassembly and reassembly operations of the conveyor roller from and on the system.

Moreover, the support means are suitably configured to maintain the guide cylinder in contact with the second support shaft and simultaneously to allow thermal expansions of the conveyor roller.

BRIEF DESCRIPTION OF THE DRAWING FIGURES

Further characteristics and advantages will be more apparent from the indicative, and therefore non-limiting, description of an example of a preferred, but not exclusive, embodiment of the invention, as shown in the accompanying figures, wherein:

FIGS. 1*a* and 1*b* are two schematic views respectively in a side and plan view, of a drying system of a coated continuous film, according to the invention;

Figure 2:
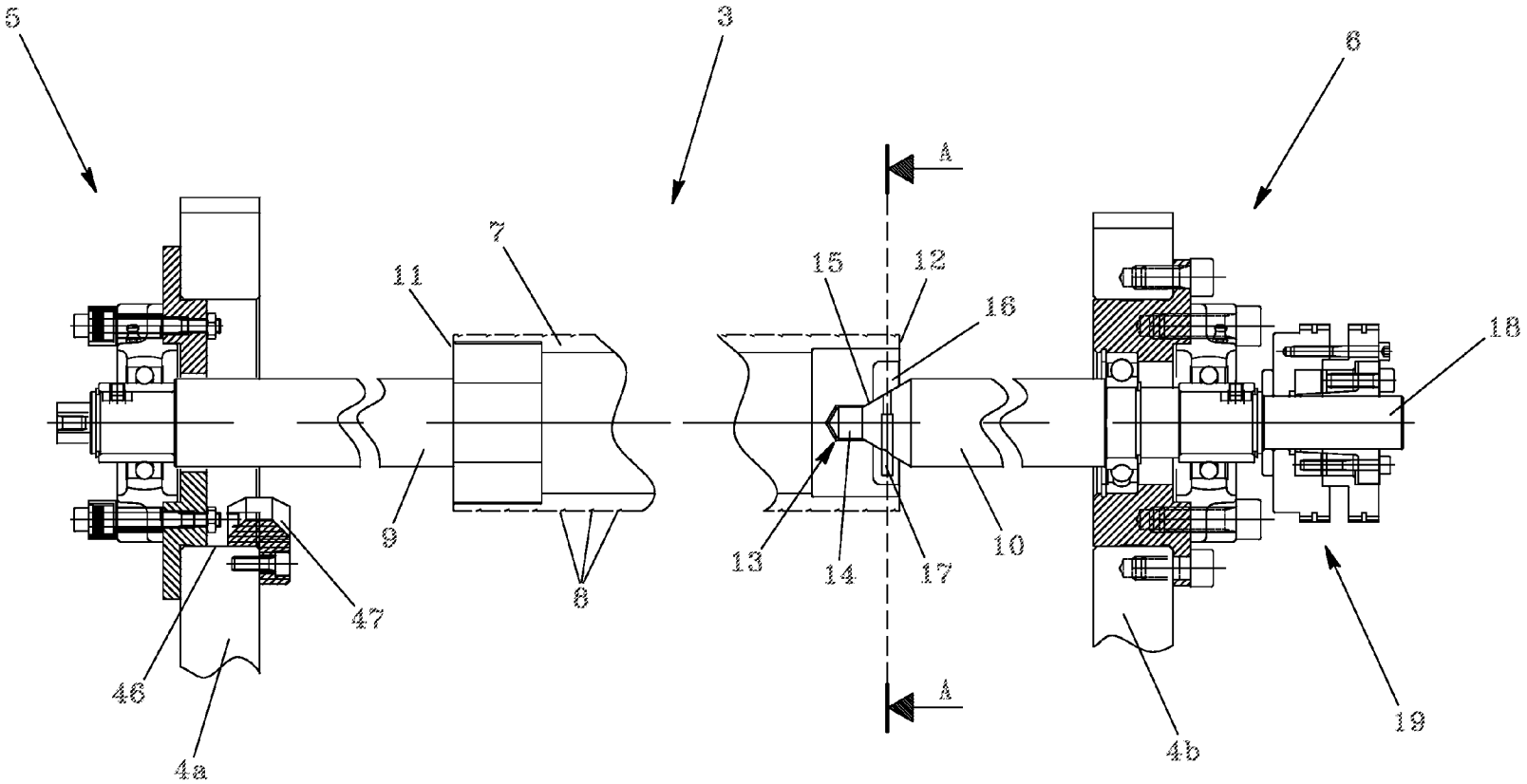
FIG. 2 is a sectional view of a roller conveyor device of a continuous film of a drying system of a coated continuous film.
Figure 6:
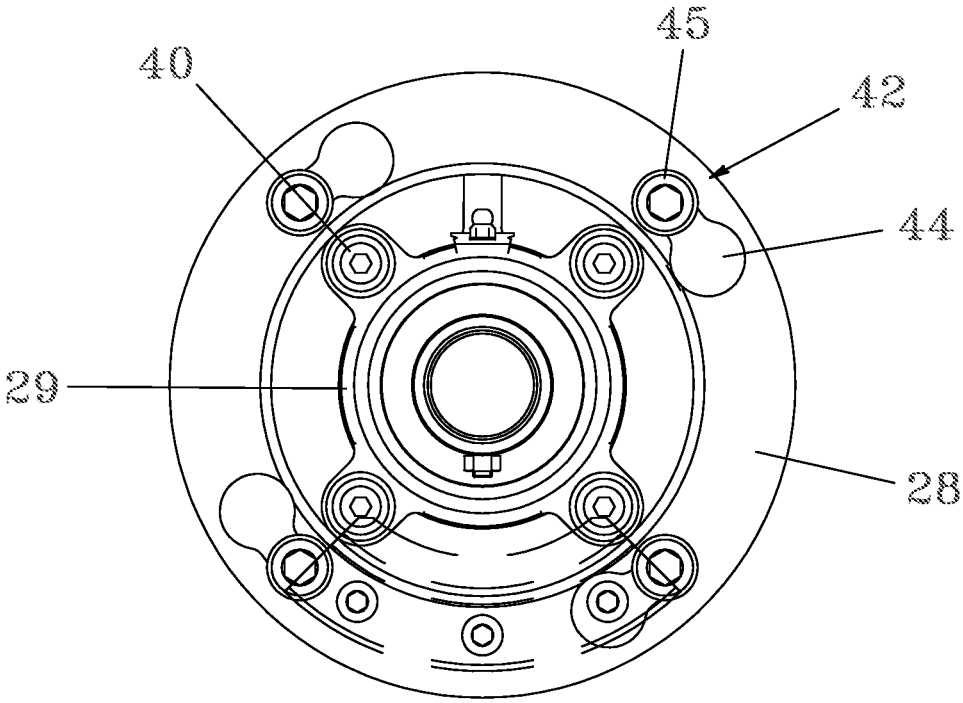
Figure 5B:
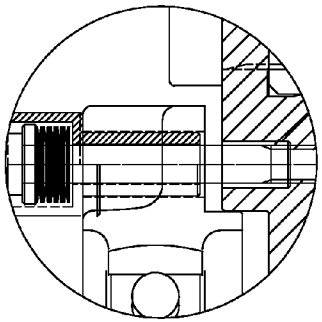
FIG. 5 is a further detailed view of the roller conveyor device of FIG. 2.
Figure 5:
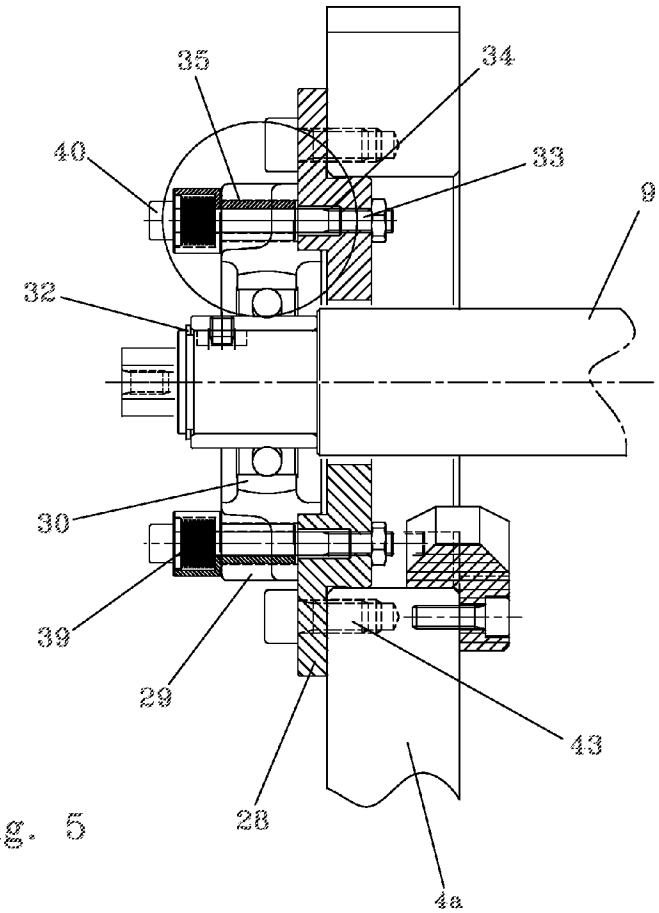
Figure 5A:
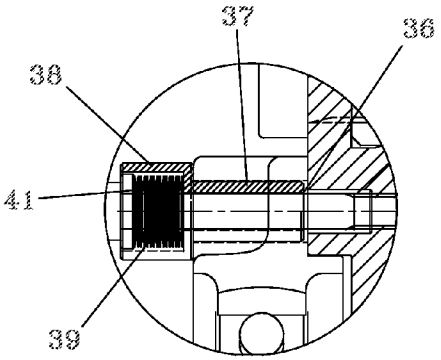

FIGS. 5*a* and 5B are two details of FIG. 5, respectively in two operating configurations;

FIG. 6 is a side view of the roller conveyor device of FIG. 2.

DETAILED DESCRIPTION OF THE INVENTION

Figure 1A:
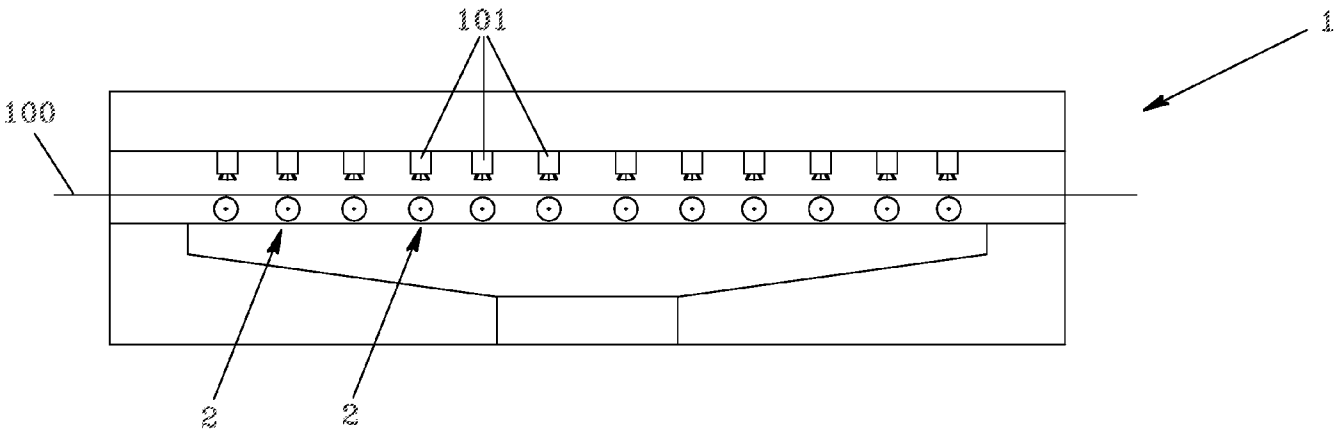
Figure 1B:
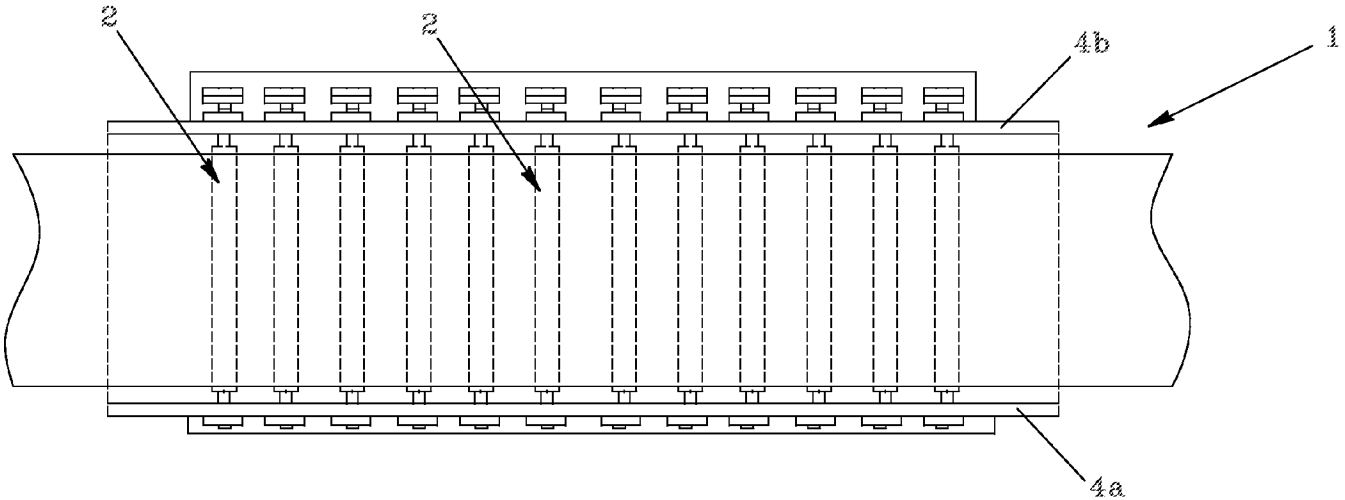

With reference to the accompanying FIGS. 1 and 2, the drying system of a coated continuous film, indicated as a whole with 1, comprises a plurality of roller conveyor devices 2 of a film 100 mounted on a pair of side members 4*a* and 4*b* of said drying system.

In detail, each roller conveyor device 2 comprises a conveyor roller indicated with 3, first support means 5 and second support means 6 of said roller on the side members 4*a* and 4*b* of the drying system 1.

Said conveyor roller 3 in turn comprises a central part constituted by a guide cylinder 7 of a continuous film, preferably made of metal, for example aluminium or steel, whose surface has a series of incisions 8 to improve conveying of the film and limit the cushion effect of the layer or air interposed between said film and the surface of the cylinder.

Instead, two support shafts 9 and 10, respectively supported by the support means 5 and 6, are provided at the ends of said cylinder 7.

In particular, a first support shaft 9 is provided at one end 11 of said cylinder 7 and integral with said guide cylinder, while a seat 13 adapted to house a second support shaft 10 is provided at the opposite end 12 of the guide cylinder 7.

In detail, said second support shaft 10 has a first end 14 configured in a manner substantially complementary to that of the seat 13 formed in the guide cylinder 7, in such a manner as to be able to mate therewith.

Advantageously, said seat 13 and said end 14 have a conical shoulder area 15 to facilitate centering of the second support shaft 10 with the guide cylinder 7, and to prevent possible locking of the end 14 due to radial expansion thereof caused by the increase in temperature.

Said seat 13 is also provided with a slot 16, adapted to house a driving pin 17 projecting radially from the end 14 of the second support shaft 10.

Figure 3:
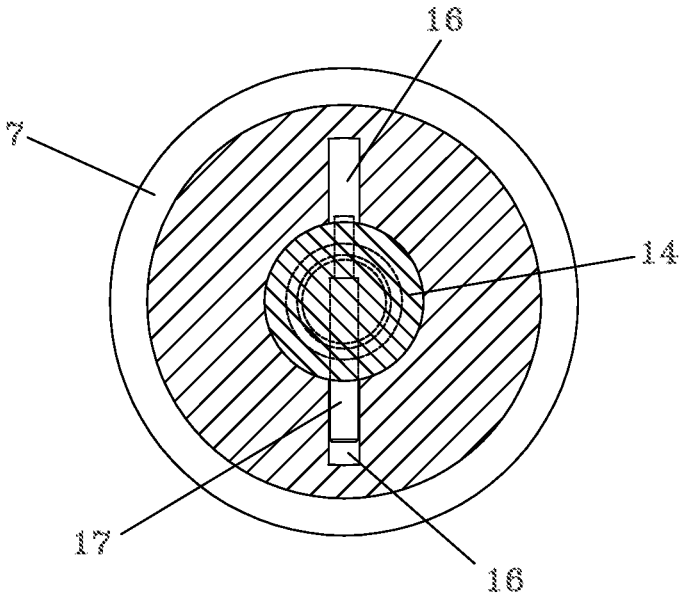
FIG. 3 is a view according to the plane of section A-A of the roller device of FIG. 2.

In detail, said slot 16 has a width substantially identical to the diameter of the pin so that that by engaging the slot 16, said pin can transmit motion from the second support shaft 10, driving in rotation the guide roller 7 and the conveyor roller 3 as a whole (FIG. 3).

Means for transmitting motion to the conveyor roller 3, such as pulleys 19 or the like, are instead fitted onto the opposite end 18 of the second support shaft 10.

In this way, the conveyor roller 3 is substantially separable into two parts with at least one of the two support shafts, in this case the second support shaft 10, separable from the rest of the roller to facilitate disassembly and reassembly operations of the conveyor roller 3 from and on the system.

In fact, this solution makes it possible to remove only a part of the conveyor roller 3 from the drying system, i.e. the first support shaft 9 integral with the guide cylinder 7, to perform cleaning or maintenance operations outside the machine.

In this way, it is unnecessary to remove all the motion transmission elements, such as the pulleys 19, connected to the second support shaft 10.

For correct operation of the roller conveyor device, the support means 5 and 6 are suitably configured to maintain the guide cylinder 7 in contact with the second support shaft 10 and, simultaneously, to allow thermal expansions of the conveyor roller 3 caused by the high temperatures inside the system.

In particular, axial movement of the second support shaft 10 is prevented in the second support means 6, while the first support shaft 9 is able to move axially in the first support means 5.

Figure 4:
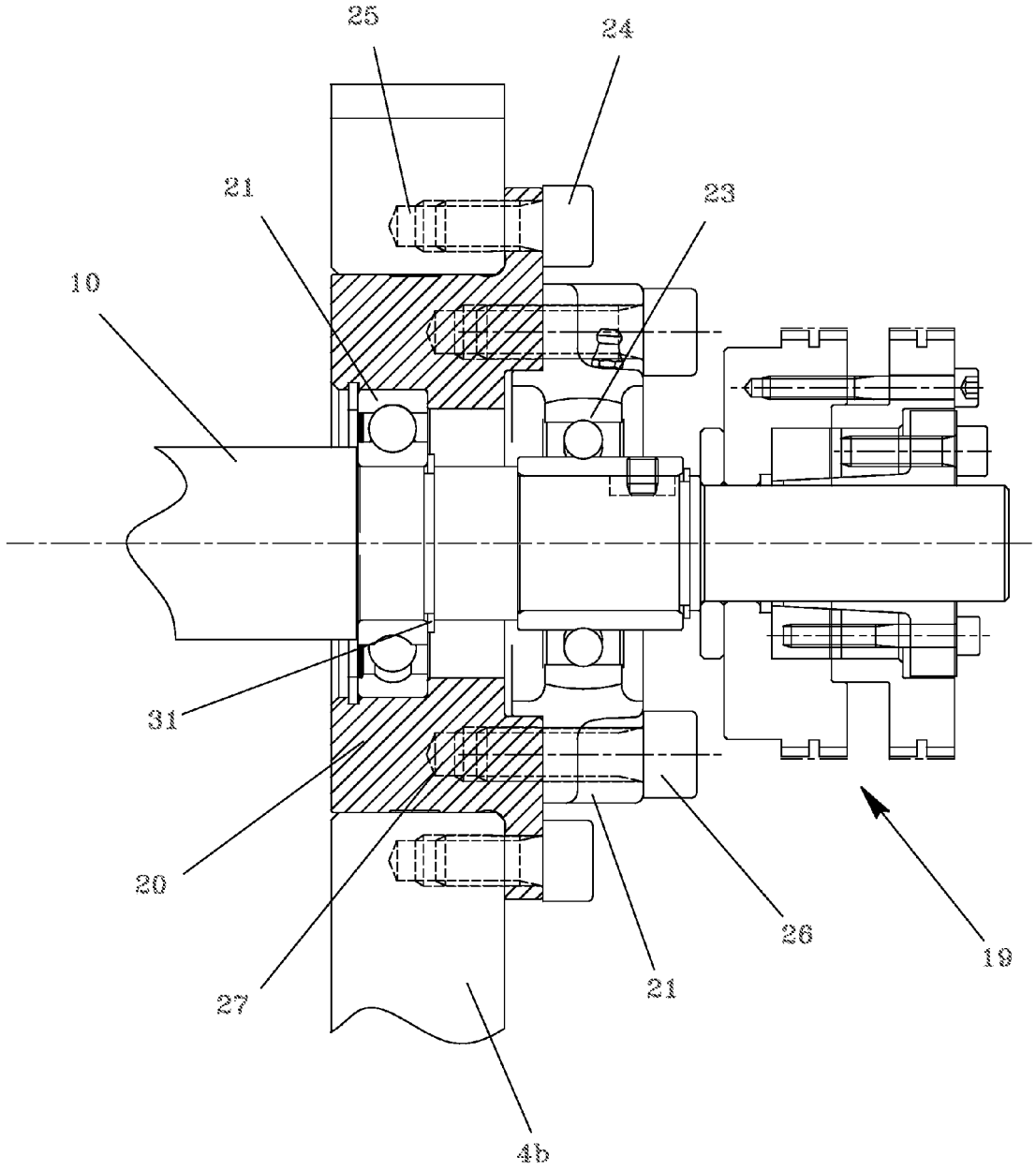
FIG. 4 is a detailed view of the roller conveyor device of FIG. 2.

With reference to FIG. 4, said support means 6 in detail comprise a support flange 20 (hereinafter called "first flange") mounted integrally on the side member 4*b* of the system and in which a bearing 21 is inserted, and a flange 22 (hereinafter called "second flange"), connected to said first support flange 20, and in which a second bearing 23 is housed.

In detail, said first support flange 20 is mounted on the side members 4*b* by means of a plurality of bolts 24 inserted in the same number of seats 25 formed in the side members 4*b*.

The second flange 22 is instead mounted integrally on said first support flange 20 by means of a series of bolts 26 inserted in the same number of seats 27.

The second support shaft 10 is fitted on both bearings 21 and 23 and axial movement is prevented by means of elastic rings 31 or the like.

With reference to FIG. 5, the support means 5, similarly to the support means 6, also comprise a support flange 28 (hereinafter called "third flange") mounted integrally on the side members 4*a* of the system and a flange 29 (hereinafter called "fourth flange"), connected to said third support flange 28, and in which a bearing 30 is housed.

The first support shaft 9 is fitted on the bearing 30 housed in the fourth flange 29 and axial movement is prevented by means of elastic rings 32 or the like. Advantageously, unlike the support means 6, said support means 5 allow said fourth flange 29 to move with respect to the third support flange 28 along the direction of the axis of the support roller 3.

In this way, the support roller 3 can undergo axial thermal expansion which is released onto the end of the first support shaft 9.

To allow perfect centering between the second support shaft 10 and the guide cylinder 7 at all times and to maintain these parts in contact at all times, there are advantageously provided elastic means, adapted to exert a force on said fourth flange 29 of the axis of the support roller 3.

In detail, the fourth flange 29 is connected to the third support flange 28 by means that allow the fourth flange 29 to slide away from or toward the third support flange 28 along a direction parallel to the axis of the conveyor roller 3. FIGS. 5*a* and 5*b* show a detail of the connection area of the fourth flange 29 on the third support flange 28, respectively with the roller not expanded and with the roller thermally expanded with an increase in the total axial length thereof.

With reference to said FIGS. 5, 5*a* and 5*b*, the fourth flange 29 is connected to the third support flange by means of bolts 33 inserted in specific holes 34 formed in the third flange 28.

Said means which allow the fourth flange 29 to slide with respect to the third flange 28 comprise a plurality of bushings 35 housed in the same number of seats 36 formed in the fourth flange 29, into which the connection bolts 33 are inserted.

The bushings 35 have a first segment 37 of lesser diameter adapted to house the stem of the bolt 33 and a second segment 38 of greater diameter adapted to house elastic means 39, such as Belleville washers, coil springs or the like. In detail, said elastic means are interposed between the head 40 of the bolts 33 and the shoulder 41 of the bushings 35.

In this way, an elastic force is exerted on the bushings 35, transmitted through contact to the fourth flange 29, which tends to move said fourth flange 29 toward the third flange 28.

In the same way, given that axial movement of the first support shaft 9 prevented with said fourth flange 29, the elastic force is transmitted through said first support shaft 9 to the guide cylinder 7 to the second support shaft 10.

In this way, between the end 14 of the second support shaft 10 and the seat 13 of the guide cylinder 7, there is always a certain contact pressure that allows the two parts of the roller to be maintained connected and centred.

Moreover, on the third support flange 28 there are provided a series of slots 42, level with the fixing bolts 43, to facilitate the operations for disassembly of the support means 5 for removal of the conveyor roller 3 (FIG. 6).

In detail, the slots 42 have a widened segment 44 that allows passage of the heads 45 of the fixing bolts 43, in such a manner as to be able to remove the third support flange 28 without having to remove the bolts 43 from the side member 4*a* of the system.

Moreover, on the edge 46 of the side member 4*a* of the system there is provided a supporting lip 47, preferably made of a low friction material, such as Teflon or similar plastic materials.

In particular, said lip acts as a support for sliding of the guide cylinder 7, when this is removed from the system to perform cleaning or maintenance operations, preventing contact between the metal material of the side member 4*a* of the system and the guide cylinder 7.

Operation of the device takes place as described below:

when the drying system of a coated continuous film is switched off, all the components are at room temperature, and the conveyor rollers 3, not thermally expanded, are positioned in the support means as shown in FIG. 5*a*. When the system is started up the nozzles 101 blow hot air onto the coated film 100 to evaporate any solvents or humidity contained therein.

The temperature inside the system therefore starts to increase, in general up to 150° C., causing thermal expansion of the various components, including the conveyor rollers 3.

If the conveyor roller 3 were to be mounted with axial movement prevented in the support means 5 and 6, this expansion would be prevented with consequent generation of strains damaging both for said support means and for the roller itself.

As a result of the present invention, this expansion is instead compensated by the fact that the fourth flange 29 can slide away from or toward the third support flange 28 along a direction parallel to the axis of the conveyor roller 3.

In this way, all the thermal deformation of the roller is transferred to the end of the first support shaft 9 housed in the support means 5.

The presence of the elastic means 39 adapted to exert a force in axial direction on said fourth flange 29 also allows a certain contact pressure to be maintained at all times between the end 14 of the second support shaft 10 and the seat 13 of the guide cylinder 7, to maintain the two parts of the cylinder connected and centred.

During the air blowing operation, due to natural causes or an error by the operator, a certain quantity of coating material of the film may be deposited on the various components of the system, and in particular on the guide cylinders 7 of the conveyor rollers 3.

Due to the present invention the conveyor rollers 3 can be removed easily from the system to perform cleaning operations. In fact, it is sufficient to loosen the fixing bolts 43 of the third support flange 28, rotate said flange to bring the heads 45 of the bolts level with the widened segments 44 of the slots 42, and remove the entire guide cylinder 7 together with the first support shaft and with the support means 5.

After the cleaning or maintenance operations have been completed, the operation can be repeated in reverse order to reassemble the conveyor roller 3 on the system.

The second support shaft 10, to which the pulleys 39 for transmission of motion are connected, instead remains mounted on the system in the support means 6; in this way it is possible to remove even only one roller at a time and keep the machine running during the cleaning operation on each individual roller.

The drying system of a coated continuous film, as described, is susceptible to numerous modifications and variants, all included within the scope of the inventive concept; moreover, all details can be replaced with other technically equivalent elements.

The invention claimed is:

1. A drying system of a coated continuous film comprising a plurality of conveyor rollers (3) supported at ends by a first support (5) and a second support (6) mounted on side members (4*a*, 4*b*) of the drying system, wherein said conveyor roller (3) comprises:

a guide cylinder (7) of the coated continuous film;

a first support shaft (9) integral with a first end (11) of said guide cylinder (7) housed in the first support (5);

a second support shaft (10) placed at a second end (12) of said guide cylinder (7) housed in the second support (6) and having a first end (14) adapted to couple with said second end (12) of the guide cylinder (7), and wherein the first support (5) comprises:

a support flange (28) integral with the side member (4*a*) of the drying system by means of fixing bolts (43);

a flange (29) connected to said support flange (28), there being provided a sliding device adapted to allow said flange (29) to slide toward and away from said support flange (28) along a direction parallel to the axis of the conveyor roller (3);

an elastic device which exerts an axial force on the flange (29) in a direction moving said flange (29) toward the support flange (28), the axial movement of said first support shaft being prevented with respect to said flange (29), so that the guide cylinder (7) is maintained in contact with said second support shaft (10), and wherein the support flange (28) is arranged on the side member (4*a*) of the drying system so that the guide cylinder (7) together with the first support shaft (9) and the first support (5) can be removed from the drying system by sliding the guide cylinder (7) through the side member (4*a*).

2. The drying system of a coated continuous film according to claim 1, wherein at the second end (12) of said guide cylinder (7) there is provided a seat (13) adapted to couple with said first end (14) of the second support shaft (10), said seat (13) and said first end (14) of said second support shaft (10) being configured in a complementary manner to maintain said second support shaft and said guide cylinder (7) centered.

3. The drying system of a coated continuous film according to claim 2, wherein said seat (13) and said end (14) form a conical shoulder (15) to facilitate centering of said second support shaft (10) with the guide cylinder (7).

4. The drying system of a coated continuous film according to claim 3, wherein said seat (13) has a slot (16), adapted to house a driving pin (17) projecting radially from the end (14) of the second support shaft (10).

5. The drying system of a coated continuous film according to claim 3, wherein on said support flange (28) there are provided a series of slots (42) level with the fixing bolts (43) of the flange on the side member (4*a*) of the system, said slots having a widened segment (44) of greater dimension with respect to that of the heads (45) of the fixing bolts (43).

6. The drying system of a coated continuous film according to claim 3, wherein on an edge (46) of the side member (4*a*) of the drying system there is provided a supporting lip (47) which acts as a support for sliding of the guide cylinder (7) when removed from the drying system.

7. The drying system of a coated continuous film according to claim 2, wherein said seat (13) has a slot (16), adapted to house a driving pin (17) projecting radially from the end (14) of the second support shaft (10).

8. The drying system of a coated continuous film according to claim 7, wherein on said support flange (28) there are provided a series of slots (42) level with the fixing bolts (43) of the flange on the side member (4*a*) of the system, said slots having a widened segment (44) of greater dimension with respect to that of the heads (45) of the fixing bolts (43).

9. The drying system of a coated continuous film according to claim 7, wherein on an edge (46) of the side member (4*a*) of the drying system there is provided a supporting lip (47) which acts as a support for sliding of the guide cylinder (7) when removed from the drying system.

10. The drying system of a coated continuous film according to claim 2, wherein said sliding device comprises a plurality of bushings (35) housed in the same number of seats (36) formed in the flange (29), into which bolts (33) are inserted for connection of said flange (29) on the support flange (28), said bushings (35) having a first segment (37) of lesser diameter adapted to house the stem of the bolt (33) and a second segment (38) of greater diameter adapted to house the elastic device (39).

11. The drying system of a coated continuous film according to claim 2, wherein on said support flange (28) there are provided a series of slots (42) level with the fixing bolts (43) of the flange on the side member (4*a*) of the system, said slots having a widened segment (44) of greater dimension with respect to that of the heads (45) of the fixing bolts (43).

12. The drying system of a coated continuous film according to claim 2, wherein on an edge (46) of the side member (4*a*) of the drying system there is provided a supporting lip (47) which acts as a support for sliding of the guide cylinder (7) when removed from the drying system.

13. The drying system of a coated continuous film according to claim 1, wherein said sliding device comprises a plurality of bushings (35) housed in the same number of seats (36) formed in the flange (29), into which bolts (33) are inserted for connection of said flange (29) on the support flange (28), said bushings (35) having a first segment (37) of lesser diameter adapted to house the stem of the bolt (33) and a second segment (38) of greater diameter adapted to house the elastic device (39).

14. The drying system of a coated continuous film according to claim 13, wherein at the second end (12) of said guide cylinder (7) there is provided a seat (13) adapted to couple with said first end (14) of the second support shaft (10), said seat (13) and said first end (14) of said second support shaft (10) being configured in a complementary manner to maintain said second support shaft and said guide cylinder (7) centered, and said seat (13) and said end (14) form a conical shoulder (15) to facilitate centering of said second support shaft (10) with the guide cylinder (7).

15. The drying system of a coated continuous film according to claim 13, wherein at the second end (12) of said guide cylinder (7) there is provided a seat (13) adapted to couple with said first end (14) of the second support shaft (10), said seat (13) and said first end (14) of said second support shaft (10) being configured in a complementary manner to maintain said second support shaft and said guide cylinder (7) centered, and said seat (13) has a slot (16), adapted to house a driving pin (17) projecting radially from the end (14) of the second support shaft (10).

16. The drying system of a coated continuous film according to claim 13, wherein on said support flange (28) there are provided a series of slots (42) level with the fixing bolts (43) of the flange on the side member (4*a*) of the system, said slots having a widened segment (44) of greater dimension with respect to that of the heads (45) of the fixing bolts (43).

17. The drying system of a coated continuous film according to claim 13, wherein on an edge (46) of the side member (4*a*) of the drying system there is provided a supporting lip (47) which acts as a support for sliding of the guide cylinder (7) when removed from the drying system.

18. The drying system of a coated continuous film according to claim 1, wherein on said support flange (28) there are provided a series of slots (42) level with the fixing bolts (43) of the flange on the side member (4*a*) of the system, said slots having a widened segment (44) of greater dimension with respect to that of the heads (45) of the fixing bolts (43).

19. The drying system of a coated continuous film according to claim 18, wherein on an edge (46) of the side member (4*a*) of the drying system there is provided a supporting lip (47) which acts as a support for sliding of the guide cylinder (7) when removed from the drying system.

20. The drying system of a coated continuous film according to claim 1, wherein on an edge (46) of the side member (4*a*) of the drying system there is provided a supporting lip (47) which acts as a support for sliding of the guide cylinder (7) when removed from the drying system.

* * * * *